US007153144B2

(12) United States Patent
Ohsawa et al.

(10) Patent No.: US 7,153,144 B2
(45) Date of Patent: Dec. 26, 2006

(54) MODULE CONNECTOR

(75) Inventors: Fumio Ohsawa, Tokyo (JP); Masaki Hayashi, Tokyo (JP); Kiyoshi Asai, Tokyo (JP)

(73) Assignee: SMK Corporation, Tokyo (JP)

( * ) Notice: Subject to any disclaimer, the term of this patent is extended or adjusted under 35 U.S.C. 154(b) by 42 days.

(21) Appl. No.: 10/941,371

(22) Filed: Sep. 15, 2004

(65) Prior Publication Data

US 2005/0176288 A1 Aug. 11, 2005

(30) Foreign Application Priority Data

Feb. 9, 2004 (JP) ..... 2004-031617

(51) Int. Cl.
*H01R 12/00* (2006.01)

(52) U.S. Cl. ..... 439/67; 439/68; 439/928.1

(58) Field of Classification Search ..... 439/68, 439/70, 928.1, 67

See application file for complete search history.

(56) References Cited

U.S. PATENT DOCUMENTS 4,329,642 A * 5/1982 Luthi et al. ..... 324/755
5,176,525 A * 1/1993 Nierescher et al. ..... 439/68
5,249,971 A * 10/1993 Lai et al. ..... 439/70
5,360,383 A * 11/1994 Kinoshita ..... 439/620

FOREIGN PATENT DOCUMENTS

EP 1 387 442 A1 2/2004
JP 2001-292354 A1 10/2001
JP 2002-171322 A1 6/2002
JP 2003-092168 3/2003
JP 2003-92168 A1 3/2003
JP 2004-63391 A1 2/2004
JP 2004-63425 A1 2/2004
JP 2004-63787 A1 2/2004
JP 2004-95270 A1 3/2004
JP 2004-241225 A1 8/2004

OTHER PUBLICATIONS

Patent Abstracts of Japan for JP2003-092168 published on Mar. 28, 2003.

* cited by examiner

*Primary Examiner*—X. Chung-Trans
(74) *Attorney, Agent, or Firm*—Darby & Darby

(57) ABSTRACT

A module connector has a simple module base connector capable of being used instead of a module socket, thereby allowing connection to wiring members such as an inexpensive flexible flat cable. The module base connector, formed as a thin plate, is interposed between a plurality of terminals of a small-sized module and a wiring member. This base connector includes a fitting frame and a connector housing which are formed integrally. A module fitting part of the fitting frame is provided with a terminal pattern electrically connected to the plurality of terminals of the module housing. The connector housing is provided with connection terminal pieces each having an elastic contact portion connected at one end to the wiring member of a flexible flat board, and a press contact portion connected at the other end to the terminal pattern.

8 Claims, 5 Drawing Sheets

MODULE CONNECTOR

CROSS-REFERENCE TO RELATED APPLICATION

This application claims priority of Japanese Patent Application Number 2004-031617, filed Feb. 9, 2004, which is hereby incorporated by reference in its entirety.

BACKGROUND OF THE INVENTION

1. Field of the Invention

The invention relates to a module connector for connecting a small-sized module having a number of terminals, such as a CCD, a display, and a microphone intended for a cellular phone, to a wiring member such as a flexible flat cable.

2. Description of the Related Art

Among known examples of attaching a module 10 having a number of terminals and an extremely compact configuration to a wiring sheet is one such as shown in FIGS. 8(*a*) and 8(*b*) (see Japanese Unexamined Patent Application Publication No. 2003-92168).

In these diagrams, when the module 10 is fitted into a socket housing 13 of a module socket 11 from above, the lock pieces 15 of lock springs 14 arranged on the internal surfaces of the socket housing 13 are pressed by the two outer sides of the module 10. When the module 10 is pressed in further, the lock pieces 15 of the lock springs 14 return to lock on a locking surface 16 of the module 10. Electrodes on the bottom of the module 10 are pressed into contact with contacts 18 which are formed on a bottom part 17.

With the module 10 fitted thus in the module socket 11, the bottom of the module socket 11 is brought into alignment with the printed circuit pattern of a flexible printed circuit (FPC) 12. Terminal portions 19 protruding from contact insertion holes 20 of the module socket 11 are connected electrically by such means as soldering and conductive adhesion, and fixed mechanically as well.

In the example of attaching the module 10 to the module socket 11, the height of the module socket 11 covers almost the entire module 10, and also has a complicated structure. Besides, the mounting on the FPC 12 requires complicated work processes including the step of aligning the module socket 11 to the printed circuit pattern, and the step of connecting the terminal portions 19 by soldering, conductive adhesion, or other means after the alignment. There have also been other problems. For example, higher costs are required since expensive FPCs 12 are available. Also, forming the circuit pattern for connecting the module 10 with an FPC 12 has many restrictions as to circuit pattern layout and thus makes space saving difficult.

SUMMARY OF THE INVENTION

An object of the present invention is to use a simple module base connector instead of the module socket, thereby allowing a connection with wiring members such as an inexpensive flexible flat cable.

A module connector, according to an embodiment of the present invention, comprises a module base connector formed as a thin plate and interposed between a plurality of terminals of a small-sized module and a wiring member. This module base connector includes: a fitting frame having terminals electrically connected to the plurality of terminals formed on a module housing of the module; and a connector housing having connection terminal pieces each connected at one end to the terminals of the fitting frame and at the other end to terminals of the wiring member. According to another embodiment of the present invention, in the above configuration, the connector housing and the fitting frame are formed integrally. A module fitting part formed on the fitting frame is provided with a terminal pattern electrically connected to the plurality of terminals formed on the module housing. The connector housing is provided with connection terminal pieces each having an elastic contact portion connected at one end to the wiring member and a press contact portion connected at the other end to the terminal pattern.

According to these aspects of the present invention, a module base connector formed as a thin plate is interposed between a plurality of terminals of a small-sized module and a wiring member. This module base connector includes: a fitting frame having terminals electrically connected to the plurality of terminals formed on a module housing of the module; and a connector housing having connection terminal pieces each connected at one end to the terminals of the fitting frame and at the other end to terminals of the wiring member. This connector can provide a simpler and thinner structure instead of a module socket. Besides, a flexible flat cable (FFC) can be used as the wiring member. It is therefore possible to omit complicated work processes including the step of aligning to a printed circuit pattern and the step of connecting terminal portions by soldering, conductive adhesion, etc. Consequently, the module connector can be provided at lower cost.

According to another embodiment of the present invention, the connector housing and the fitting frame are formed integrally. A module fitting part formed on the fitting frame is provided with a terminal pattern electrically connected to the plurality of terminals formed on the module housing of the module. The connector housing is provided with connection terminal pieces each having an elastic contact portion connected at one end to the wiring member and a press contact portion connected at the other end to the terminal pattern. Since the connection terminal pieces are formed on the connector housing, the elastic contact portions at one end of each of the connection terminal pieces are connected to the wiring member, and the press contact portions at the other end of each of the connection terminal pieces are pressed into contact with the terminal pattern of the module fitting part. This can simplify the step of connecting terminals. In addition, the use of a flexible flat cable (FFC) as the wiring member can eliminate the restrictions as to circuit pattern layout, and allow space saving as compared to the case of making a circuit pattern for connecting the module with an FPC.

According to another embodiment of the present invention, the connector housing and the fitting frame are formed integrally. The connector housing is provided with connection terminal pieces each having elastic contact portions connected at one end to the wiring member and press contact portions extended at the other end to a fitting part formed on the fitting frame so as to be electrically connected to the plurality of terminals formed on the module housing, the elastic contact portions and the press contact portions being integrated respectively. It is therefore possible to establish connection with the plurality of terminals formed on the module housing without forming a terminal pattern on the module fitting part.

According to another embodiment of the present invention, the connector housing and the fitting frame are formed separately. An insertion piece inserted into an insertion part of the connector housing is integrally formed on the fitting frame. Press contact pieces are formed and exposed on one side of this insertion piece. These press contact pieces are extended so that they are partially exposed in the fitting part formed on the fitting frame to make press contact portions electrically connected to the plurality of terminals formed on the module housing. Connection terminal pieces each having terminal portions connected at one end to the press contact pieces within the insertion part and at the other end to the wiring member are formed inside the connector housing. Consequently, the step of attaching the module to the fitting frame, the step of connecting an FFC or an FPC with the connector housing, and the step of inserting the fitting frame into the connector housing can be performed separately from each other, thereby improving the assembly yield of expensive modules such as the FPC.

According to another embodiment of the present invention, the connector housing and the fitting frame are formed separately. An insertion piece inserted into an insertion part of the connector housing is integrally formed on the fitting frame. Press contact pieces are formed and exposed on one side of this insertion piece. These press contact pieces are extended at the other ends so that they are partially exposed in the fitting part formed on the fitting frame to make press contact portions electrically connected to the plurality of terminals formed on the module housing. The connection terminal pieces are formed inside the connector housing. The connection terminal pieces are integrally provided with elastic contact parts connected to the press contact pieces within the insertion part and elastic contact portions connected to the wiring member within the insertion slot. The connector housing can thus be connected easily by simply inserting the fitting frame with the module attached thereto and inserting the wiring member. In addition, an inexpensive flexible flat cable can be used as the wiring member. The use of the flexible flat cable can also eliminate the restrictions as to circuit pattern layout and allow space saving as compared to the case of making a circuit pattern for connecting the module with an FPC.

According to another embodiment of the present invention, a through hole for allowing the module to be attached inversely is made in the fitting part of the fitting frame. The module can thus be attached upward or downward depending on its intended use.

BRIEF DESCRIPTION OF THE DRAWINGS

The foregoing and other features of the present invention will be more readily apparent from the following detailed description and drawings of the illustrative embodiments of the invention wherein like reference numbers refer to similar elements and in which.

DETAILED DESCRIPTION OF THE PREFERRED EMBODIMENTS

Figure 1:
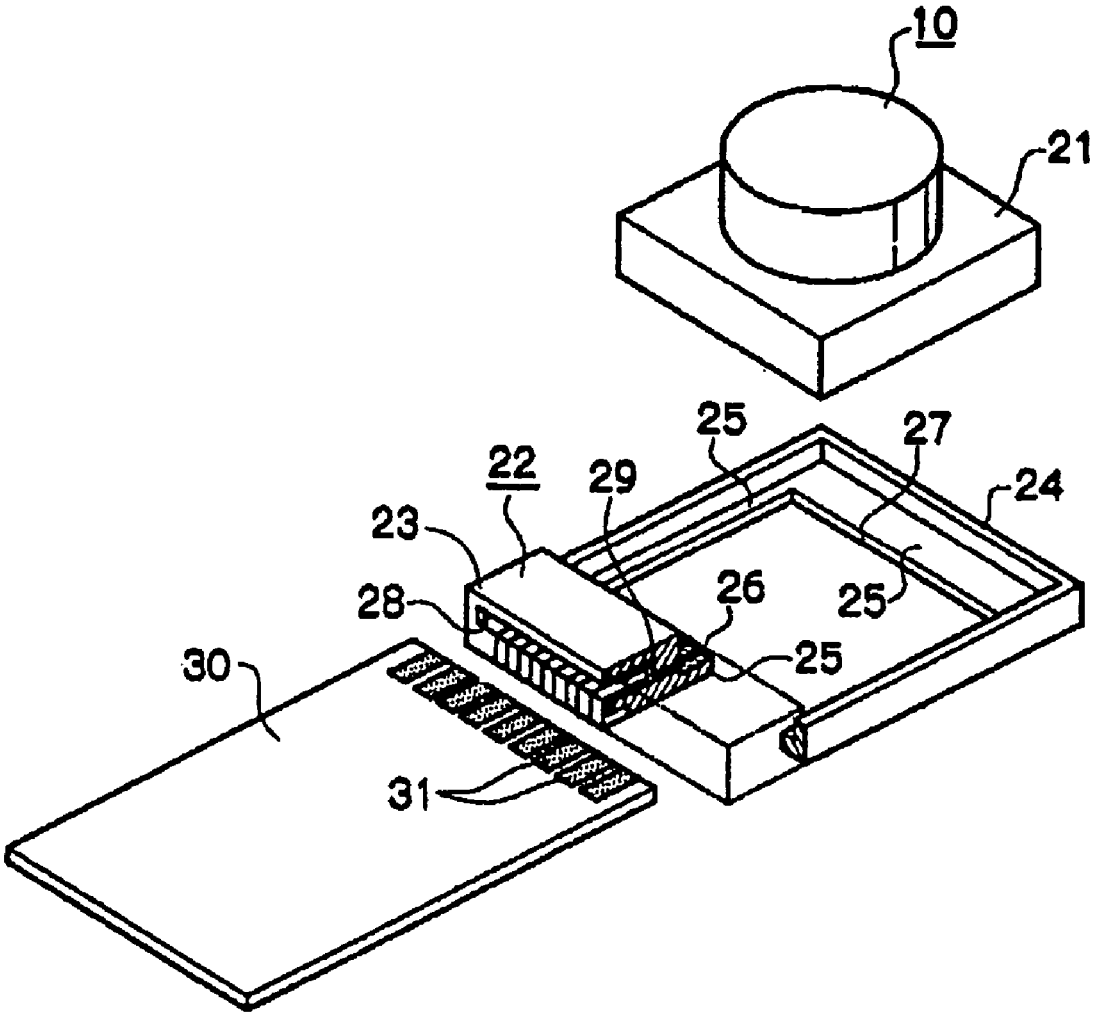
FIG. 1 is an exploded perspective view showing an embodiment of the module connector according to the present invention before the assembly of a module and an FFC.

In the present invention, a module base connector formed as a thin plate is interposed between a plurality of terminals of a small-sized module and a wiring member. This module base connector includes a fitting frame and a connector housing. The fitting frame has terminals electrically connected to a plurality of terminals formed on a module housing of the module. The connector housing has connection terminal pieces each connected at one end to the terminals of the fitting frame and at the other end to terminals of the wiring member.

The connector housing and the fitting frame are formed integrally. A module fitting part formed on the fitting frame is provided with a terminal pattern electrically connected to the plurality of terminals formed on the module housing. The connector housing is provided with connection terminal pieces each having an elastic contact portion connected at one end to a wiring member such as a flexible flat cable and a press contact portion connected at the other end to the terminal pattern.

A through hole for allowing the module to be attached inversely may or may not be formed in the fitting part of the fitting frame.

Moreover, the connector housing and the fitting frame may be formed separately. Here, an insertion piece inserted into an insertion part of the connector housing may be formed integrally on the fitting frame.

An embodiment of the present invention will be described with reference to FIGS. 1 to 2(*c*).

The reference numeral 10 designates a module which has an extremely small size on the order of several millimeters to several centimeters and has a number of terminals, such as a CCD camera, a display, and a microphone intended for a cellular phone. A module housing 21 of this module 10 has a number of electrodes which are formed and exposed on the bottom thereof. These electrodes are arranged at the same intervals so as to establish connection with a terminal pattern 26 on a module base connector 22 to be described later.

The module base connector 22 is intended to connect the module 10 with a wiring member 30, and is formed as a thin plate rather than a socket. While the following embodiments deal with cases where the wiring member 30 is an inexpensive flexible flat cable (FFC), other members such as a circuit board, an FPC, and an IC card may also be used.

Figure 2B:
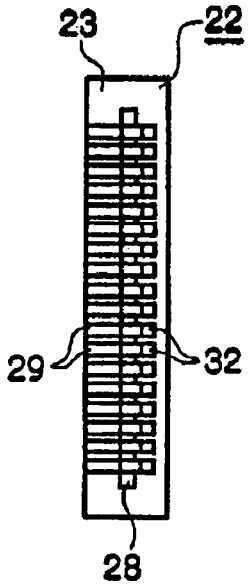
FIGS. 2(*a*), 2(*b*), and 2(*c*) are a plan view, a left side view, and a longitudinal sectional front view, respectively, showing the module base connector of FIG. 1.
Figure 2A:
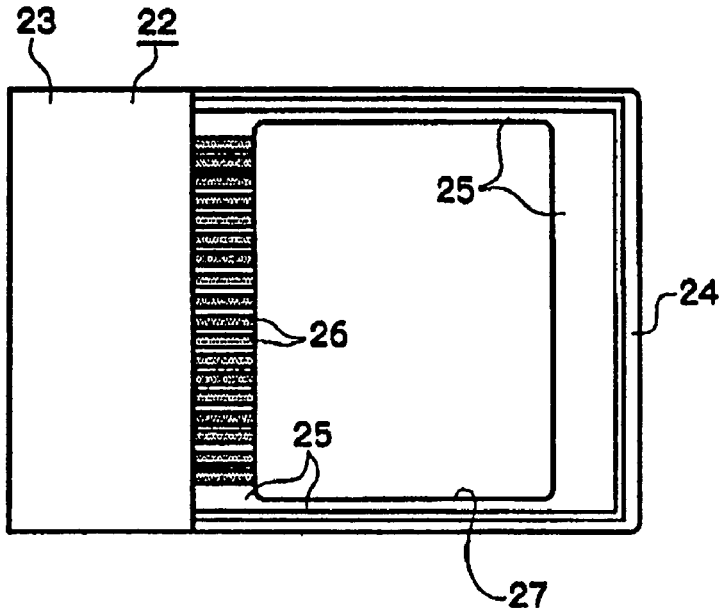
Figure 2C:
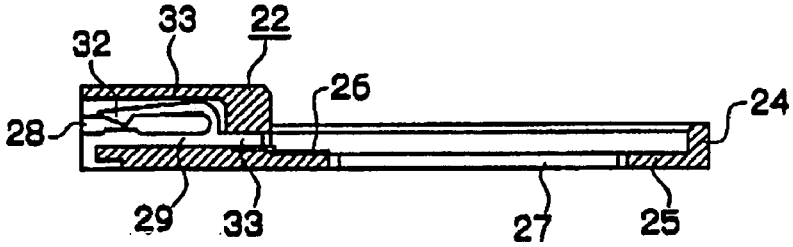

In the embodiment shown in FIGS. 1–2(*c*), the module base connector 22 is composed of a connector housing 23 for establishing connection with an FFC 30, and a fitting frame 24 for establishing connection with the module 10. The connector housing 23 and the fitting frame 24 are formed integrally. A fitting part 25 to which the module housing 21 is fitted and attached is recessed shallowly inside the fitting frame 24. A number of traces of the terminal pattern 26 are formed at predetermined intervals on a side of the fitting part 25 that is closer to the connector housing 23. A through hole 27 is also formed in the center of the fitting part 25.

The side of the connector housing 23 opposite from the fitting frame 24 is drilled to make an insertion slot 28 into which the FFC 30 is inserted for the sake of connection with printed terminal portions 31 of the FFC 30. Connection terminal pieces 29 are pressed into and fixed to the insertion slot 28. These connection terminal pieces 29 each have an elastic contact portion 32 of U shape on the side into which the FFC 30 is pressed, and a press contact portion 33 on the side closer to the terminal pattern 26. Then, the press contact portions 33 are pressed into electrical contact with the traces of the terminal pattern 26 which extend toward the press contact portions 33.

Figure 3A:
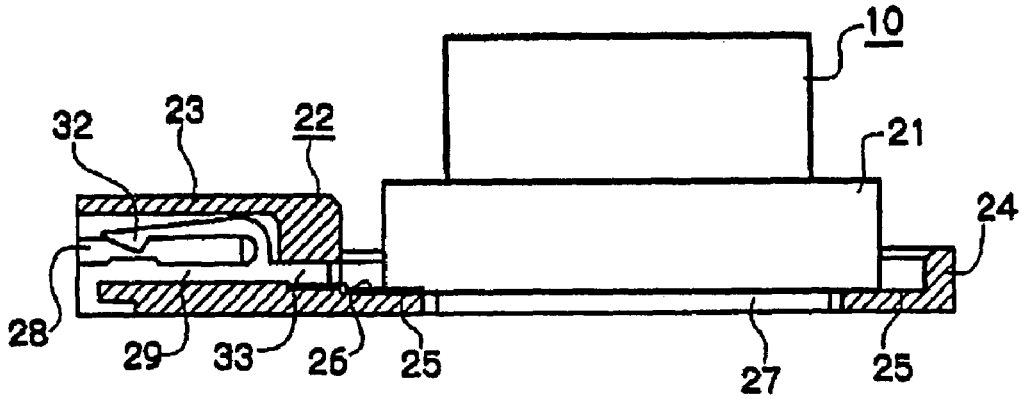
FIGS. 3(*a*) and 3(*b*) are sectional views of the module connector of FIG. 1 when the module is attached upward and when the module is attached downward, respectively.
Figure 3B:
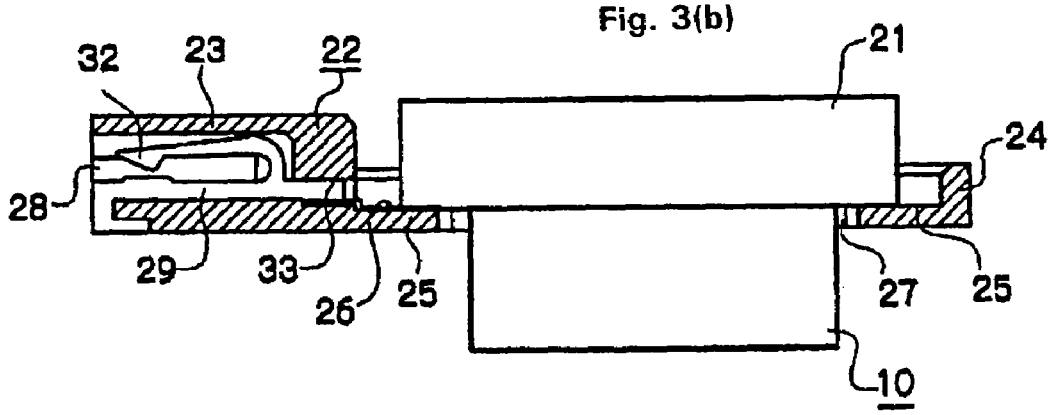

In such a configuration, as shown in FIG. 3(*a*), the module housing 21 is placed on the fitting part 25 of the fitting frame 24 of the module base connector 22 with the module 10 upward. The electrodes on the bottom of the module housing 21 and the terminal pattern 26 on the top of the fitting part 25 are then connected electrically by such means as a conductive adhesive and brazing.

When the FFC 30 is pressed into the insertion slot 28 in the connector housing 23 of the module base connector 22, the elastic contact portions 32 come into electric contact with the printed terminal portions 31 of the FFC 30 while the FFC 30 is sandwiched and held by the connection terminal pieces 29.

The example of assembly shown in FIG. 3(*a*) is of the case where the electrodes are formed on the bottom of the module housing 21 of the module 10.

FIG. 3(*b*) shows, on the other hand, an example of assembly where the electrodes are formed on the top of the module housing 21 of the module 10. In this case, the module 10 is put downward and fitted into the through hole 27 of the fitting frame 24. The electrodes on the top of the module housing 21 and the terminal pattern 26 on the top of the fitting part 25 are then connected electrically by such means as a conductive adhesive and brazing.

Figure 4:
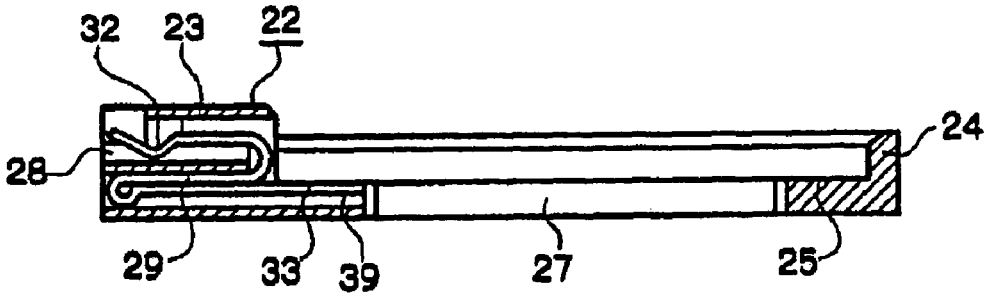
FIG. 4 is a longitudinal sectional front view showing another embodiment of the module base connector according to the present invention.

FIG. 4 shows another embodiment of the present invention. In this embodiment, the press contact portions 33 of the connection terminal pieces 29 are extended to the top of fitting part 25, instead of the traces of the terminal pattern 26 on the fitting part 25. These connection terminal pieces 29 are bent twice into an S shape. The elastic contact portions 32 are arranged to face the insertion slot 28, and the press contact portions 33 are exposed in the fitting part 25. In the fitting part 25, a gap part 39 is also formed beneath the press contact portions 33 so as to give elasticity to the press contact portions 33. Even in this example, the through hole 27 is formed in the fitting frame 24. As shown in FIGS. 3(*a*) and 3(*b*), it is therefore possible to attach the module 10 in either direction, upward or downward (inversely).

Figure 5A:
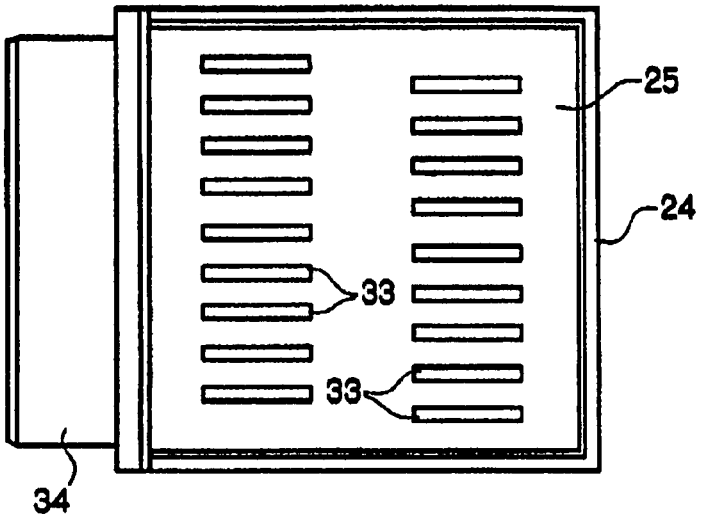
FIGS. 5(*a*) and 5(*b*) are a plan view and a longitudinal sectional front view, respectively, showing another embodiment in which the module base connector of the present invention is separated into a connector housing and a fitting frame.
Figure 5B:
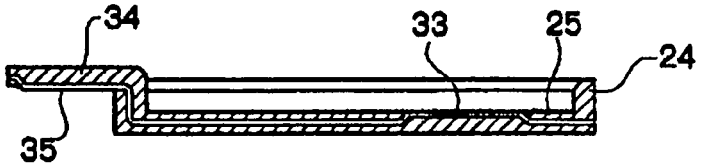

FIGS. 5(*a*), 5(*b*), and 6 show another embodiment of the present invention. In this embodiment, the connector housing 23 and the fitting frame 24, which constitute the module base connector 22, are formed separately.

As shown in FIGS. 5(*a*) and 5(*b*), the separated fitting frame 24 has the same fitting part 25 as the one described above, and an insertion piece 34 formed as a thin plate which extends integrally from a side of the fitting frame 24. Elongated press contact pieces 35 are formed and exposed on the bottom of this insertion piece 34 at the same intervals as those of the traces of the terminal pattern 26. The press contact pieces 35 are extended through the interior of the fitting frame 24 and exposed as the press contact portions 33 on the top of the fitting part 25. If the pitch intervals are small, the press contact portions 33 are exposed on the top of the fitting part 25 alternately.

Figure 6:
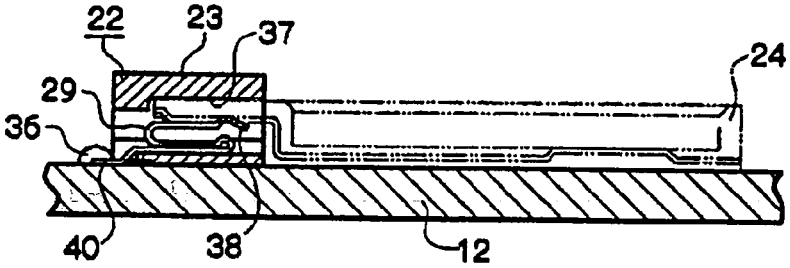
FIG. 6 is a longitudinal sectional front view showing an example where the fitting frame of the embodiment of FIGS. 5(*a*) and 5(*b*) is assembled with the connector housing and connected with an FPC.

The separated connector housing 23 is configured as shown in FIG. 6. That is, an insertion part 37 into which the insertion piece 34 is inserted is formed in one side of the connector housing 23. Connection terminal pieces 29, bent twice into an S shape, are attached to the inside of the insertion part 37. The connection terminal pieces 29 each have an elastic contact part 38 which is formed to face the insertion part 37, and a terminal portion 40 which protrudes integrally from the other side of the connector housing 23.

In such a configuration, the terminal portions 40 of the connector housing 23 are placed on and aligned to the circuit pattern of the FPC 12. The terminal portions 40 are connected electrically by solder 36, and fixed mechanically as well. The insertion piece 34 of the fitting frame 24 is pressed into the insertion part 37 of the connector housing 23, so that the press contact pieces 35 of the fitting frame 24 and the insertion part 37 of the connection terminal pieces 29 come into contact for electrical and mechanical connection.

In the embodiment shown in FIG. 6, the module base connector 22 is of a separated type, being composed of the separate connector housing 23 and the fitting frame 24, and the connector housing 23 is connected to the FPC 12.

Figure 7:
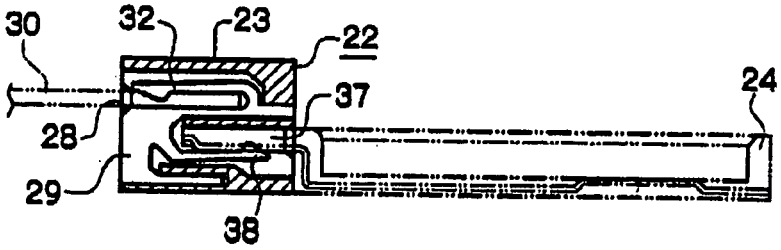
FIG. 7 is a longitudinal sectional front view showing another embodiment of the present invention in which the fitting frame of the embodiment of FIGS. 5(*a*) and 5(*b*) is assembled with a connector housing different from in FIG. 6 and connected with an FFC.
Figure 8A:
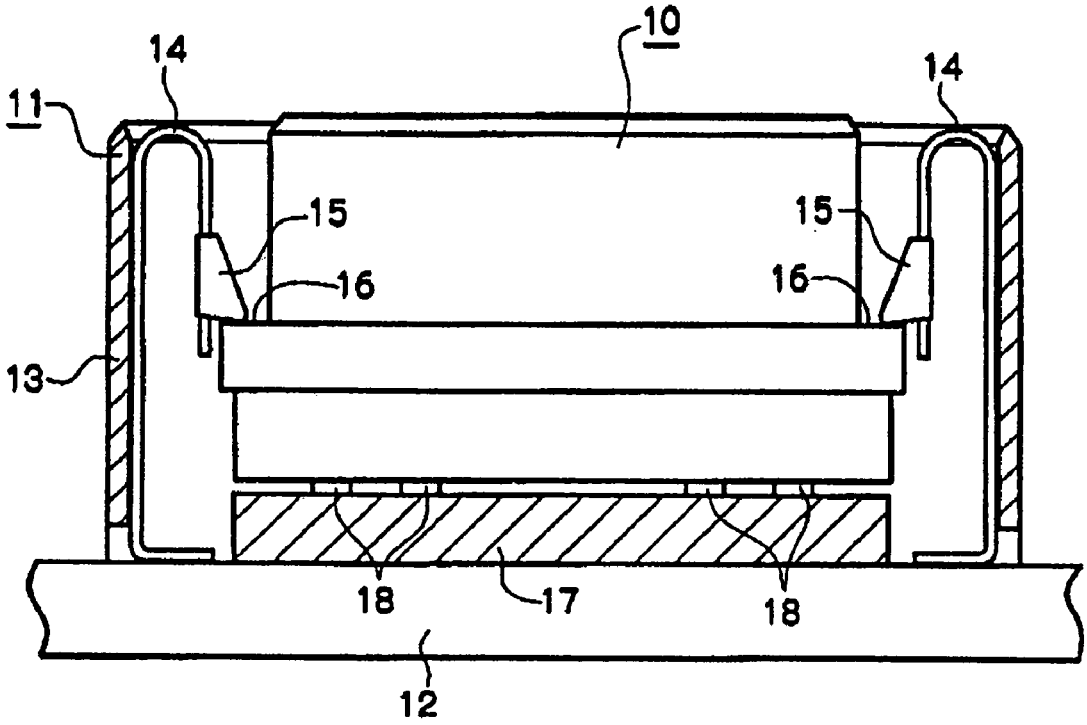
Fig. 8(a) PRIOR ART
FIGS. 8(*a*) and 8(*b*) are a longitudinal sectional front view and a longitudinal sectional side view, respectively, showing a conventional module base connector.
Figure 8B:
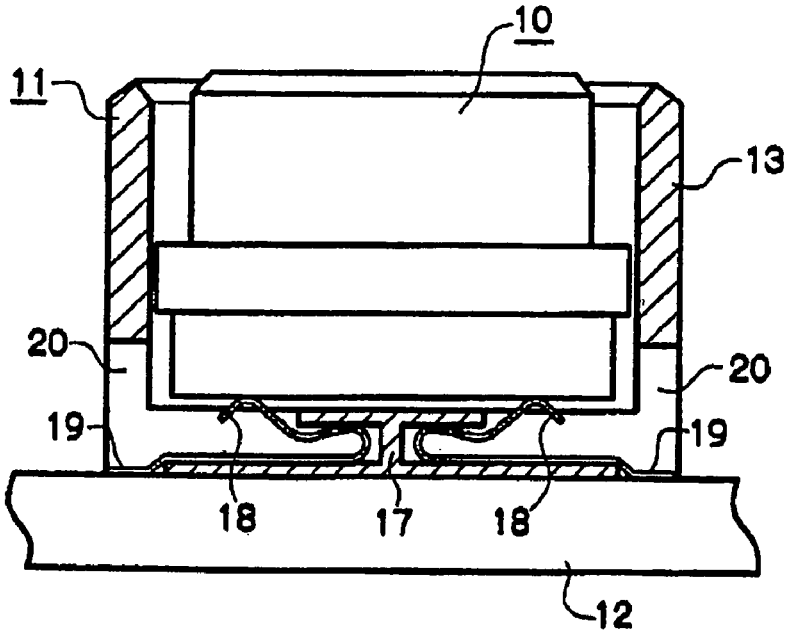
Fig. 8(b) PRIOR ART

In another embodiment shown in FIG. 7, the module base connector 22 is also of a separated type, being composed of the separate connector housing 23 and the fitting frame 24, whereas the connector housing 23 is connected to the FFC 30. The insertion part 37 into which the press contact pieces 35 are pressed is formed in one side of the connector housing 23, and the insertion slot 28 into which the FFC 30 is inserted is formed in the other side. Then, the connection terminal pieces 29 each having the elastic contact portion 32 and the elastic contact part 38 are pressed into the insertion slot 28 and the insertion part 37.

In such a configuration, the insertion piece 34 of the fitting frame 24 is pressed into the insertion part 37 to connect the elastic contact parts 38 and the press contact pieces 35. The FFC 30 is pressed into the insertion slot 28 to connect the elastic contact portions 32 and the printed terminal portions 31.

The embodiments of the present invention described above have dealt with the cases where the module 10 is attached to only one of the sides of the fitting frame 24. This is not restrictive, however. Any of the module base connectors 22 as shown in FIGS. 1 to 7 may be formed on two sides integrally so that two modules 10 can be attached to both sides.

The module connector according to the present invention can be used as a module base connector 22 necessary to attach small-sized modules 10, having a number of terminals, and intended not only for a cellular phone, but also for a personal computer, a printer, a game machine, etc.

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A module connector comprising:

a module base connector formed as a thin plate and interposed between a plurality of terminals formed on a module housing of a small-sized module and a wiring member, the module base connector comprising:

a fitting frame having terminals electrically connected to the plurality of terminals formed on the module housing of the module; and a connector housing having connection terminal pieces connected at first ends thereof to the terminals of the fitting frame and at second ends to terminals of the wiring member, wherein the terminals of the fitting frame extend in a straight line from within a rear portion of the connector housing and along a surface of the fitting frame on which the electrical connection in made between the terminals of the fitting frame and the plurality of terminals formed on the module housing of the module;

wherein the connector housing and the fitting frame are formed integrally, the fitting frame having a module fitting part formed thereon and provided with a terminal pattern electrically connected to the plurality of terminals formed on the module housing, and wherein the connector housing is provided with at least one of the connection terminal pieces having an elastic contact portion connected at the second end of the connection terminal piece to the wiring member and a press contact portion connected at the first end of the connection terminal piece to the terminal pattern.

2. The module connector according to claim 1, wherein a through hole for allowing the module to be attached inversely is made in the fitting part of the fitting frame.

3. A module connector comprising:

a module base connector formed as a thin plate and interposed between a plurality of terminals formed on a module housing of a small-sized module and a wiring member, the module base connector comprising:

a fitting frame having terminals electrically connected to the plurality of terminals formed on the module housing of the module; and a connector housing having connection terminal pieces connected at first ends thereof to the terminals of the fitting frame and at second ends to terminals of the wiring member, wherein the terminals of the fitting frame extend in a straight line from within a rear portion of the connector housing and along a surface of the fitting frame on which the electrical connection in made between the terminals of the fitting frame and the plurality of terminals formed on the module housing of the module;

wherein the connector housing and the fitting frame are formed integrally, and wherein the connector housing is provided with at least one of the connection terminal pieces having an elastic contact portion connected at the second end of the connection terminal piece to the wiring member and a press contact portion extended at the first end of the connection terminal piece to a fitting part formed on the fitting frame so as to be electrically connected to the plurality of terminals formed on the module housing, the elastic contact portion and the press contact portion being integrated respectively.

4. The module connector according to claim 3, wherein a through hole for allowing the module to be attached inversely is made in the fitting part of the fitting frame.

5. A module connector comprising:

a module base connector formed as a thin plate and interposed between a plurality of terminals formed on a module housing of a small-sized module and a wiring member, the module base connector comprising:

a fitting frame having terminals electrically connected to the plurality of terminals formed on a the module housing of the module; and a connector housing having connection terminal pieces connected at first ends thereof to the terminals of the fitting frame and at second ends to terminals of the wiring member, wherein the connector housing and the fitting frame are formed separately, an insertion piece inserted into an insertion part of the connector housing is integrally formed on the fitting frame, press contact pieces formed and exposed on one side of the insertion piece and extended -so that the press contact pieces are partially exposed in a fitting part formed on the fitting frame to make press contact portions electrically connected to the plurality of terminals formed on the module housing, and the connection terminal pieces being connected at the first ends thereof to the press contact pieces within the insertion part and at the second ends to the wiring member are formed inside the connector housing.

6. The module connector according to claim 5, wherein a through hole for allowing the module to be attached inversely is made in the fitting part of the fitting frame.

7. A module connector comprising:

a module base connector formed as a thin plate and interposed between a plurality of terminals formed on a module housing of a small-sized module and a wiring member, the module base connector comprising:

a fitting frame having terminals electrically connected to the plurality of terminals formed on a the module housing of the module; and a connector housing having connection terminal pieces connected at first ends thereof to the terminals of the fitting frame and at second ends to terminals of the wiring member, wherein the connector housing and the fitting frame are formed separately, an insertion piece inserted into an insertion part of the connector housing is integrally formed on the fitting frame, press contact pieces formed and exposed on one side of the insertion piece, and extended so that the press contact pieces are partially exposed in a fitting part formed on the fitting frame to make press contact portions electrically connected to the plurality of terminals formed on the module housing, and the connection terminal pieces are formed inside the connector housing, and are integrally provided with elastic contact parts connected to the press contact pieces within the insertion part and elastic contact portions connected to the wiring member within an insertion slot.

8. The module connector according to claim 7, wherein a through hole for allowing the module to be attached inversely is made in the fitting part of the fitting frame.

* * * * *